US006494073B2

(12) United States Patent
Oka et al.

(10) Patent No.: US 6,494,073 B2
(45) Date of Patent: Dec. 17, 2002

(54) METHOD AND APPARATUS FOR PRODUCTION OF HOLLOWED RACK BARS

(75) Inventors: Kazutomi Oka, Hiratsuka (JP); Tetsukazu Fukuhara, Hiratsuka (JP)

(73) Assignee: Neturen Co., Ltd., Tokyo (JP)

( * ) Notice: Subject to any disclaimer, the term of this patent is extended or adjusted under 35 U.S.C. 154(b) by 0 days.

(21) Appl. No.: 09/748,157

(22) Filed: Dec. 27, 2000

(65) Prior Publication Data

US 2001/0006000 A1 Jul. 5, 2001

(30) Foreign Application Priority Data

Dec. 27, 1999 (JP) ..... 11-370086

(51) Int. Cl.[7] ..... B21K 21/16
(52) U.S. Cl. ..... 72/356; 72/370.21; 72/370.06
(58) Field of Search ..... 72/343, 352, 353.2, 72/354.6, 356, 370.04, 370.06, 370.21, FOR 101

(56) References Cited

U.S. PATENT DOCUMENTS 132,899 A * 11/1872 Comly ..... 72/102
2,431,851 A * 12/1947 Warden ..... 72/370.5
4,598,451 A * 7/1986 Ohki ..... 72/370.21
6,000,267 A * 12/1999 Yagi ..... 72/370.21

FOREIGN PATENT DOCUMENTS

| | | |
|---|---|---|
| EP | 0 765 793 | 4/1997 |
| JP | 58-218339 | 12/1983 |
| JP | 59-174244 | 10/1984 |
| JP | 61-88938 | 5/1986 |
| JP | 3-5892 | 1/1991 |
| JP | 6-182472 | 7/1994 |
| JP | 6-246379 | 9/1994 |

* cited by examiner

*Primary Examiner*—Lowell A. Larson
(74) *Attorney, Agent, or Firm*—Wenderoth, Lind & Ponack, L.L.P.

(57) ABSTRACT

In a method of producing hollow rack bars from steel tubes for use in steering equipment for automobiles and so on, a part of the length of the steel tube to be processed and its adjacent parts is held in split dies that encircle a whole circumference of the tube except for the dies having a hole coinciding with the part of the tube to be processed. Then, a punch is inserted into the hole in a closed state of the dies for flattening a part of the tube, and then mandrels are pushed into the tube for ironing from the inside to form a rack pattern, when a rack forming die is inserted into the hole and held in contact with the flattened part of the tube.

8 Claims, 7 Drawing Sheets

METHOD AND APPARATUS FOR PRODUCTION OF HOLLOWED RACK BARS

BACKGROUND OF THE INVENTION

The present invention relates to a method and apparatus for production of rack bars that have a rack along a part of the length of the bars.

Rack bars are used as components of steering equipment for automobiles. The present invention provides a method and apparatus for efficient production of hollow rack bars by plastic working of steel tubes.

Conventionally rack bars for steering equipment have been made from solid bars, however, for the purpose of weight reduction in automobiles, it is desirable to employ hollow materials. FIG. 7 is a perspective view of such a rack bar 1, in which 2 indicates teeth of the rack. A conventional method for production of such a hollowed rack bar is to drill a hole in a solid bar after cutting a rack on the surface. On the other hand, a method for forming a rack by plastic working on a steel tube material is described in Japanese published patent no. 3-5892.

The method consists of two processing stages, i.e. preliminarily flattening of a part of the steel tube, and then forming a rack on the flattened part. For this method, a primary-forming split dies, which can be opened right and left, is prepared to hold a part of a steel tube to be processed, where the split die has a penetrating hole in a part to be formed a rack at a state of the dies being closed. Then, a primary formed piece is obtained by inserting a punch having a flat top into the hole and flattening the part of steel tube. In the next stage, the primary formed piece is held in secondary-forming split dies which can be opened right and left and has an inner shape coinciding with the outer shape of a rack bar product. Namely, the secondary forming split dies have a female pattern of rack teeth in their upper parts at a state of the dies being closed. Then, mandrels are inserted into the steel tube in order to perform ironing of the previously flattened part from the inside of the steel tube. Consequently, the outer surface of the primarily formed piece is bulged, and a rack is formed according to the shape of the secondary-forming split dies.

The above method does not waste material due to the plastic forming method in comparison with the cutting method, and can produce high quality products due to strengthening by plastic working. However, when the method is applied in practice, it has been found that there is room for further improvement because of the rather high cost of the dies. Namely, the primary-forming split dies are long in life because the dies are not subjected to abrasion, while the secondary-forming split dies are relatively short in life because the part of female pattern of the rack teeth is susceptible to being worn out. The rack teeth pattern is not subjected to strong abrasion that deforms the intruded bulging metal, however, because of repeated large stress acting in the rack forming process, the rack teeth pattern can be damaged resulting in the dies failing due to the formation of cracks at the bottoms of the teeth.

SUMMARY OF THE INVENTION

Among the dies and tools for use in the above-mentioned methods for production of rack bars, short life because of abrasion in some extent will be allowed in these being subjected to friction between material such as mandrels. However, contrary to the mandrels, since the secondary-forming split dies are complex in shape in the part of the rack teeth pattern and are expensive, short life of the split dies results in high production costs for the rack bars. The present invention is intended to provide an efficient method for production of rack bars by overcoming the above mentioned problems by reducing the cost of the dies and tools.

Namely, the present invention is a method of producing a hollow rack bar by processing a part of the length of a steel tube and forming a rack thereon. The method comprising: holding the steel tube in a set of split dies, which has an inner shape adapted to encircle the whole circumference of the steel tube at the part of the length to be processed and its adjacent parts of both sides except for the dies having a hole coinciding with the part of the steel tube to be processed; inserting a punch into the hole at a closed state of the dies and flattening the part of the steel tube; inserting a rack forming die into a hole of the dies with a same inner shape as aforesaid dies; holding the rack forming die in contact with the flattened part at a closed state of the dies; and inserting mandrels into an inside of the steel tube and forming a rack pattern according to the rack forming die by ironing the flattened part from the inside of the steel tube.

The above method may further comprise inserting a core bar into the steel tube during flattening the steel tube by the punch. Also in the above method, the punch and the rack forming die can be alternatively inserted into the hole of one set of the split dies, for flattening the steel tube and for forming the rack pattern. Otherwise, among two or more sets of the split dies with a same inner shape, one or more sets of the dies can be equipped with the punches for flattening the steel tube, and the other sets of the dies can be equipped with the rack forming dies for forming the rack pattern.

Moreover, the present invention is an apparatus for producing a hollow rack bar by processing a part of the length of a steel tube and forming a rack thereon. The apparatus comprising: one or two sets of split dies, which have an inner shape of encircling a whole circumference of the steel tube at the part of length to be processed and its adjacent parts of both sides except for the dies having a hole coinciding with the part of the steel tube to be processed; a punch with a flat top for inserting into the hole and flattening the steel tube; a rack forming die for holding in contact with the steel tube in the hole of the dies; and mandrels for inserting into an inside of the steel tube and forming a rack pattern according to the rack forming die by ironing the flattened part from the inside of the steel tube. Also in the above apparatus, the rack forming die may have a protruding part that is continuous in both edges at a width direction of the rack.

DETAILED DESCRIPTION OF THE PREFERRED EMBODIMENTS

Figure 1:
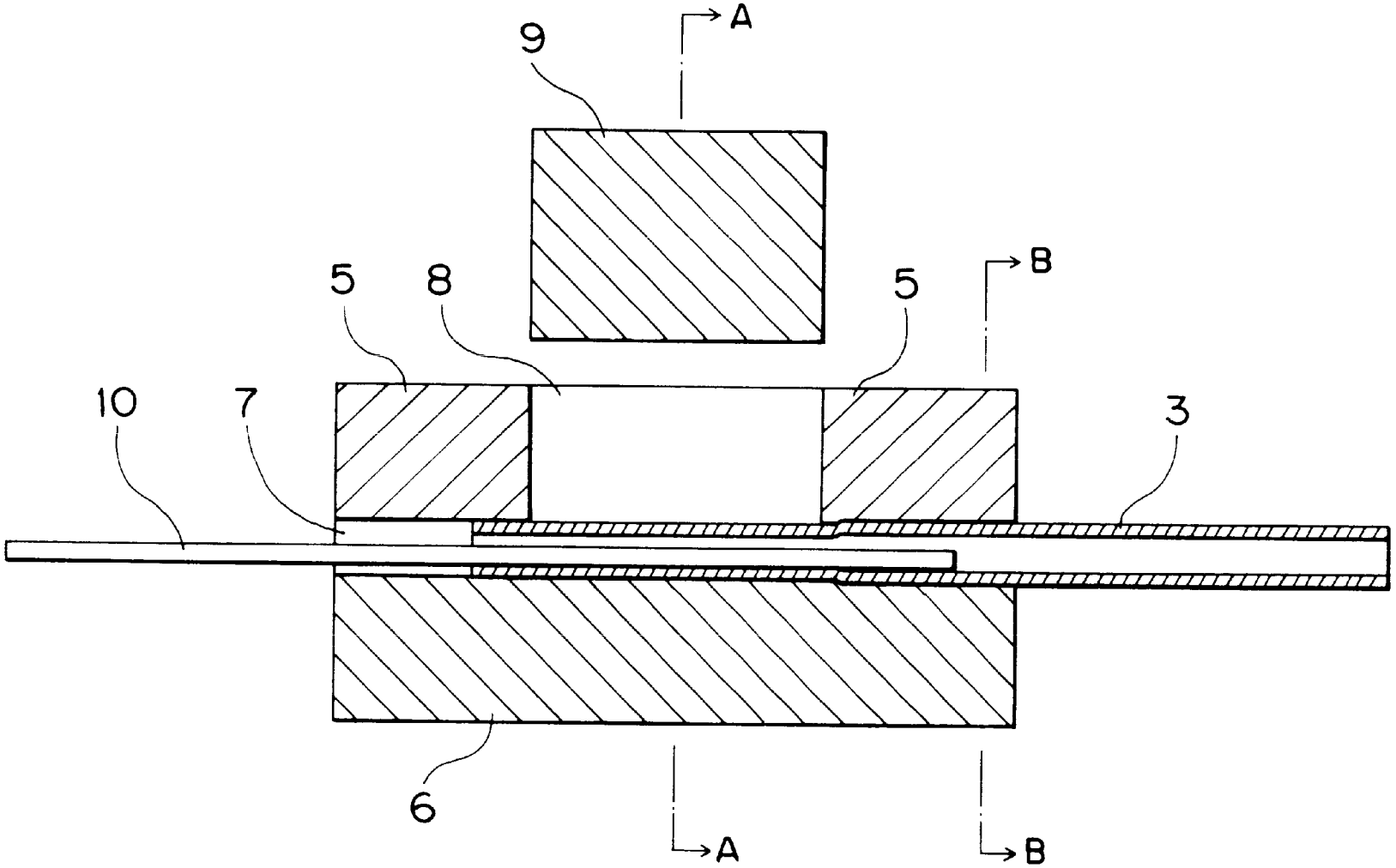
FIG. 1 is a cross-sectional view taken along a longitudinal direction of a rack bar explaining the method of this invention.
Figure 2:
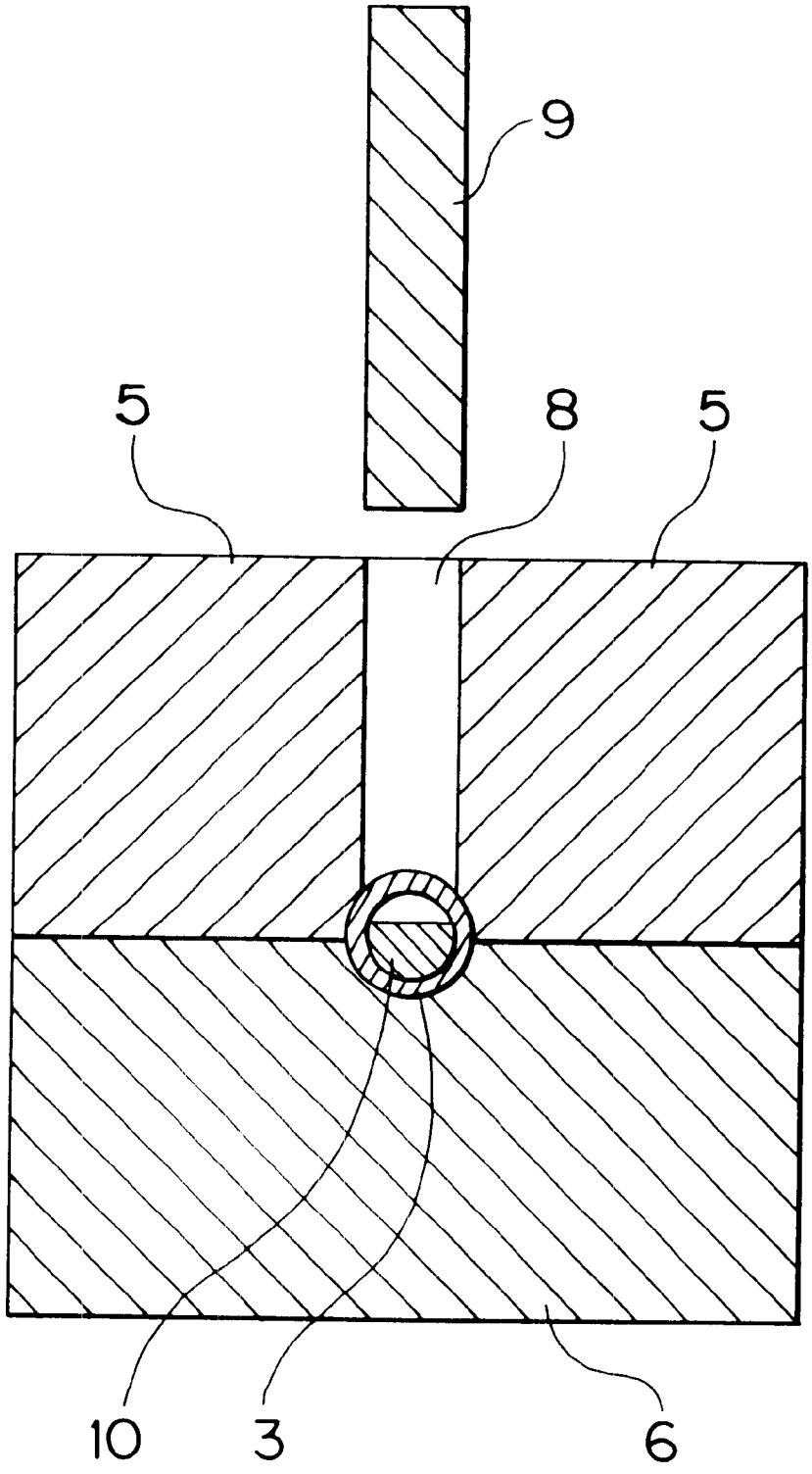
FIG. 2 and FIG. 3 are cross-sectional views perpendicular to the longitudinal direction of the rack bar at the section lines A—A and B—B in FIG. 1 respectively.
Figure 3:
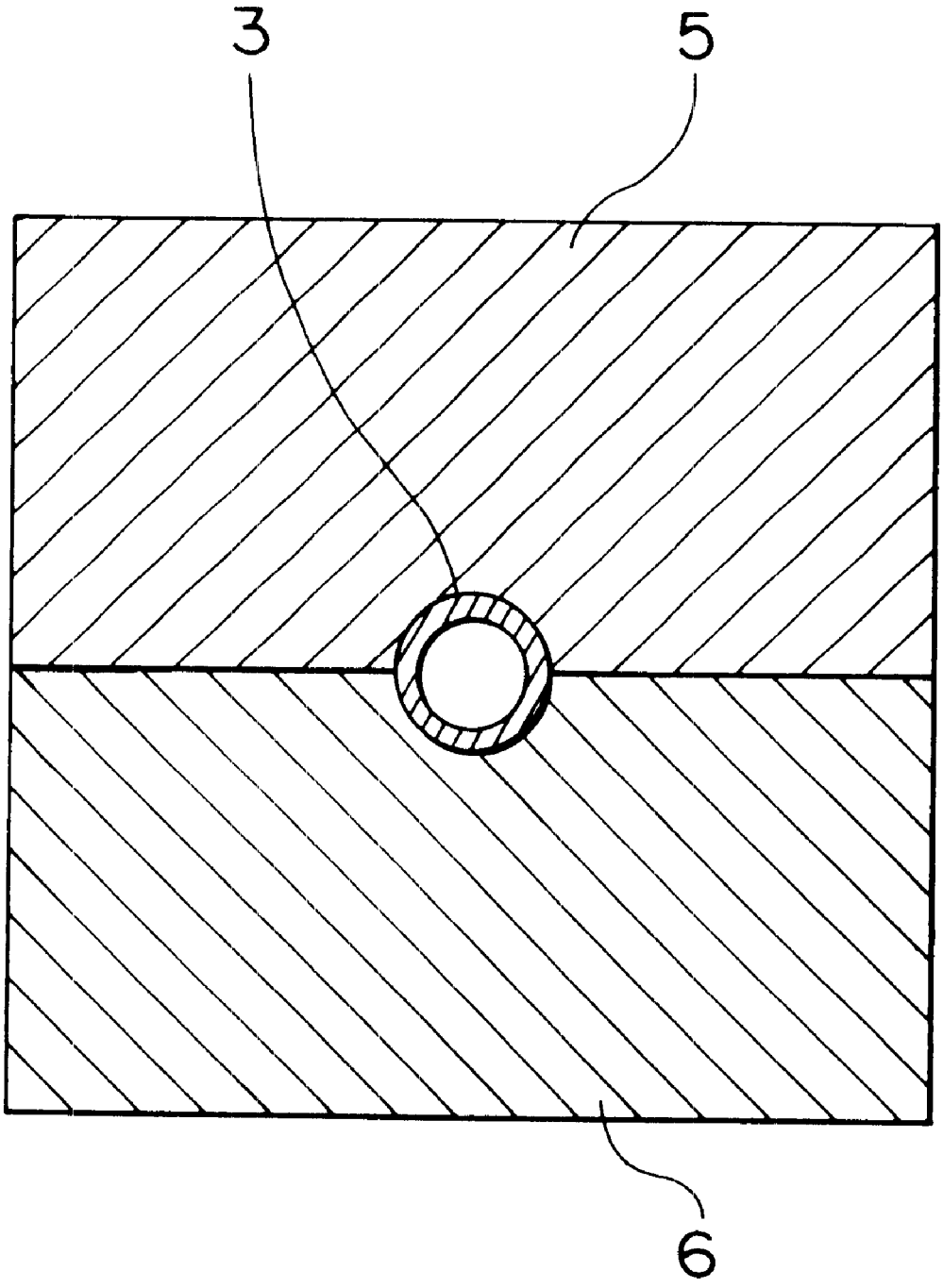
Figure 7:
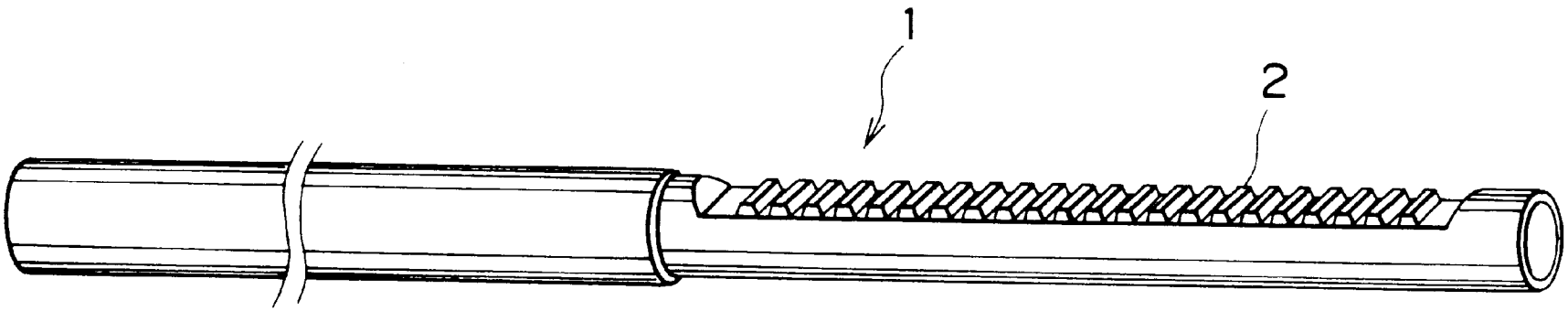
FIG. 7 is a perspective view showing a hollowed rack bar.

FIG. 1 is a cross-sectional view along a longitudinal direction of a rack bar for explaining the method of this invention, and FIG. 2 and FIG. 3 are cross-sectional views perpendicular to the longitudinal direction of the rack bar taken at the section lines A—A and B—B in FIG. 1, respectively. Reference numerals 5 and 6 are a set of split dies which has an inner shape that encircles a steel tube 3 to be processed and has a hole that will be mentioned later, when the upper and lower dies are closed. The dies are connected to an opening and shutting mechanism, which is not shown in drawings, by application of a mechanism such as hydraulic cylinders. The steel tube is accommodated in the dies along the part of length to be processed, namely the part for forming a rack, and its adjacent parts of both sides. As shown in FIG. 7, because the rack is located along only one side portion of the length of the rack bar, the other side of the length of the steel tube is outside of the dies, when the tube is accommodated in the dies. Namely, the split dies can be closed at the part of one end of the tube material, however, as will be mentioned later, it is preferable that the split dies in the closed position have a hole 7 at the extension of the tube so as the hole to be lead to the pipe, because of convenience for inserting mandrels into the tube. Besides, it is natural that the set of split dies can be composed of three or more dies contrary to the two upper and lower dies as shown in FIG. 1 and so on.

As mentioned above, the split dies 5 and 6 are shaped to encircle the whole circumference of the steel tube 3, however, at an area coinciding with a part of the tube to be processed, the dies form a hole which extends perpendicular to the axis of tube. Namely, 8 in FIG. 1 and FIG. 2 is a hole or opening in the upper die, wherein the hole has a rectangular shape coinciding with the part to be formed with a rack. After the steel tube is held in the split dies as mentioned above, a punch 9 with a flat top is inserted into the hole 8 in order to press this part of the steel tube 3 and form a flat surface thereon. The punch 9 is connected to a pressing mechanism, which is not shown in drawings, by application of equipment such as hydraulic cylinders, and has preferably a section to fill just the rectangular hole without space. During the pressing operation the interior of the tube material may be empty, however, a core bar 10 may be inserted that has a cross section coinciding with an inner shape of the flattened tube which is a segmented circle, as shown in FIG. 1 and FIG. 2. Presence of the core bar allows control of the thickness and cross-sectional shape of the flattened part by pressing between the punch and the core bar. A series of plastic working in this invention, including this flattening, can be performed as cold working, however, it naturally can be performed as hot working by heating the workpieces to high temperatures.

Figure 4:
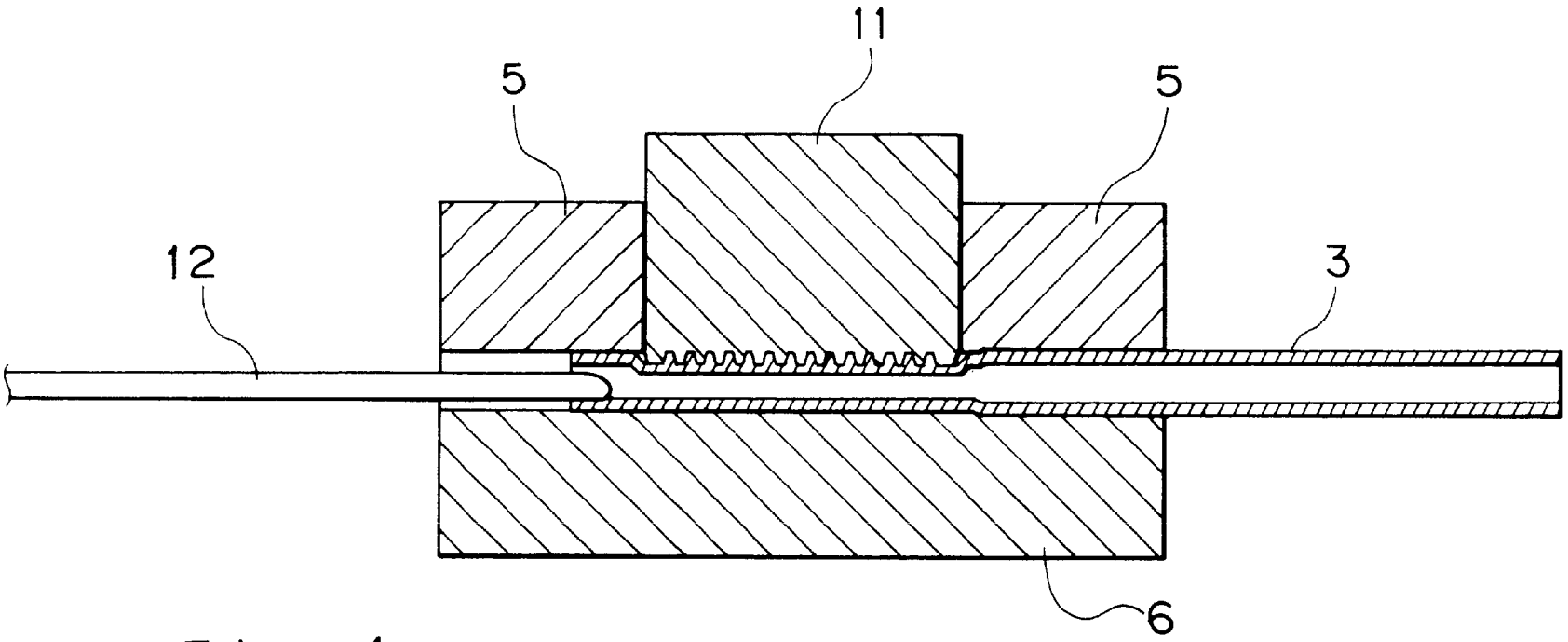
FIG. 4 is a cross-sectional view showing the next step following the process of FIG. 1 in this invention.

FIG. 4 is a cross-sectional view of the same position as shown in FIG. 1, explaining the following process. As shown in this drawing, a rack forming die 11 is inserted into the hole 8 in the upper die 5 of the split dies in place of the aforesaid punch 9, and is held in contact with the aforesaid flattened part of the steel tube 3. In this alignment a mandrel 12 is pushed into the tube to form a rack on the tube according to the rack forming die 11 by ironing the flattened part from inside of the tube. The rack forming die 11 has a same shape as the punch 9 used for flattening in the preceding process except that a female pattern of rack teeth are formed on the top, and has a cross section to fill just the hole of the split dies. Therefore, by keeping the tube material in the same split dies 5 and 6, aforesaid punch 9 can be exchanged with the rack forming die 11. Naturally, after performing the flattening process by the punch for plural tube materials, the rack forming process can be performed for those plural tube materials by replacing the punch with the rack forming die. Thus, in the method of this invention, the rack forming die can be easily exchanged.

Moreover in a large scale production process, the split dies combined with the punch and the split dies combined with the rack forming die can be made for exclusive use respectively, then the process can be performed by transferring workpieces between them. Naturally, it is not necessary to be equipped with mandrels and their pushing mechanism for the split dies combined with the punch, wherein the process for flattening of steel tubes is exclusively performed. On the other hand, for the split dies exclusively combined with the rack-forming die, the rack-forming die can be fixed to one of the split dies such as the upper die. Even in this case the advantage is not lost that the rack forming die, alone, can be exchanged.

The mandrel is inserted into the steel tube by installed to a pressing mechanism not shown in drawings. Insertion into either side of the tube does not give different effects in principle as plastic working, however, insertion from the side near the part to be formed a rack can make the mandrel shorter. For this purpose, as mentioned before referring to FIG. 1, the split dies 5, 6 in the closed position should have a hole 7 at the leading end of the steel tube. Moreover, by inserting mandrels alternatively from both ends, working time can be saved.

Figure 5:
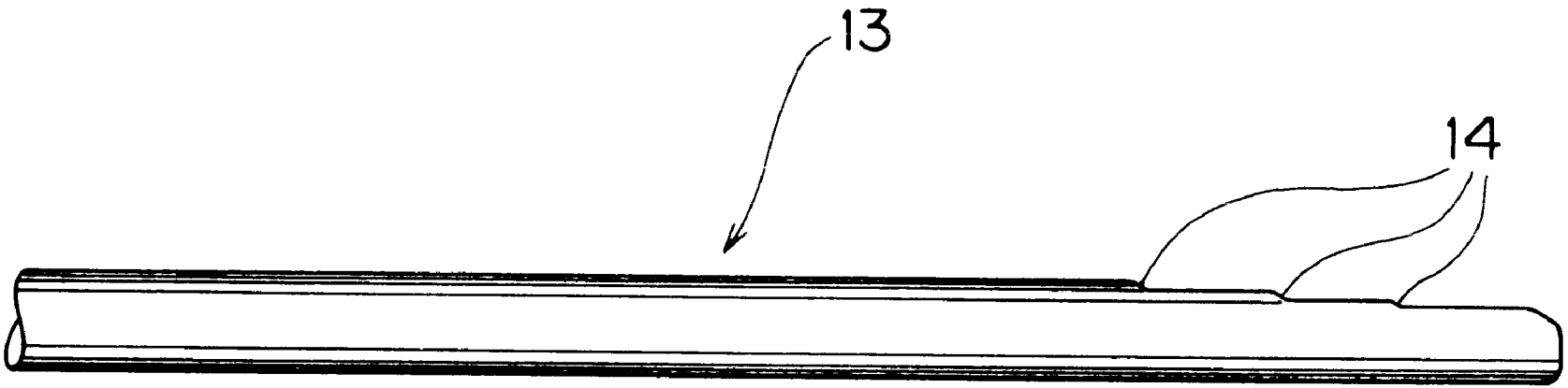
FIG. 5 is a side view of an example of a mandrel in this invention.

The ironing process by insertion of mandrels can be carried out at room temperature, however, shaping of a rack in a single step is impossible and the rack teeth should be formed in multiple steps by inserting mandrels of incremental sizes. For this purpose, by use of a mandrel as shown in a side view in FIG. 5, which has a plural steps 14 of incremental sizes at the position of ironing, the number of strokes can be reduced. Further, the mandrel can have a shape that the positions of ironing rise in lump-shape from the other part. Namely the mandrel having a series of lump with incremental heights can bring the same performance as the mandrel with multiple steps as shown in FIG. 5. Sufficient lubrication such as feeding of oil during insertion of mandrels can reduce abrasion of mandrels and decrease the force necessary for working the tube.

The present invention can produce hollow rack bars in a series of working operations mentioned above. In the apparatus disclosed in the afore-mentioned Japanese published patent no. 3-5892, because the split die and the rack teeth are combined in one body, the whole body must be replaced when the part having the teeth is damaged. In contrast, in the apparatus of this invention, only the part forming the rack forming die, which is subjected to heavy abrasion, needs to be replaced. Moreover, the split dies combined with the pattern of rack teeth are difficult to make because of complicated form, but the rack forming die according to this invention has a relatively simple form that is easy to make. Therefore, the cost for the dies is low in this invention.

Figure 6:
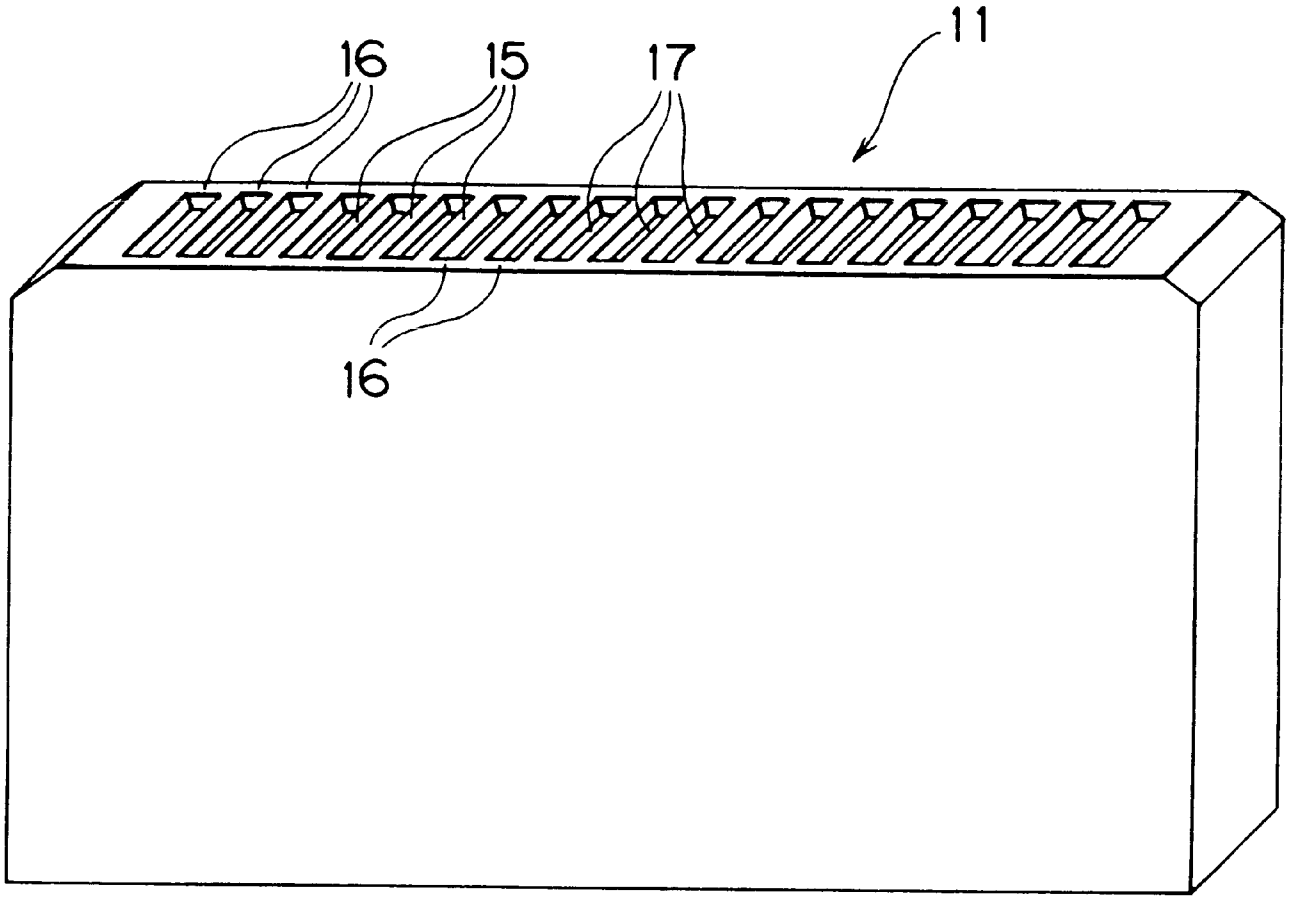
FIG. 6 is a perspective view of an example of a rack forming die in this invention.

Moreover, it has been proved that life of the rack forming die can be extended by optimization of the die form in the apparatus for production of rack bars according to this invention. Namely, for the rack forming die according to this invention, it may be thought to be common that the female pattern of the rack teeth is shaped through the whole width with the same sectional form, when cut at any position parallel to the longitudinal direction of the rack forming die. The rack forming die of such a form can be made easily by grooving with a milling cutter. However, it has been proved that the life of the rack forming die is significantly improved by shaping the die, as shown in the perspective view of FIG. 6, to have a protruding part 16 that is continuous along both edges in the width direction of the rack. By this configuration, the tops 15 of the teeth on the rack forming die, namely, the part corresponding to bottoms of teeth of a rack to be formed, are continued in both edges along the width direction of the rack.

That is, the failure mode at the end of life of a rack forming die is characterized by the appearance of cracks at the bottoms of the die teeth, namely at the part corresponding to the tops of teeth of a rack to be formed. This is thought to be a result of bending stress on the teeth of the rack die, when the metal bulging from the flattened part of the tube is blocked by the rack forming die. Consequently, as a result of the stress being concentrated to the bottom of concave place of the die, it is presumed that the ultimate strength of that part cannot endure the stress and the cracks are lead to initiate. The reason for designing the rack forming die, wherein the tops 15 of the teeth are continued in both edges at the width direction of the rack, is based on this consideration. By this configuration, the bending stress on the teeth of the rack forming die does not concentrate at the bottoms 17 of concave place on the die, but is dispersed in the continuous protruding part. Thus, crack initiation at the bottoms of concave place on the rack forming die is prevented, which leads to a longer life of the die. Besides, use of the rack forming die wherein the protruding part is continuous in the edges at the width direction of the rack, the width of rack teeth being formed is smaller than when using the rack forming die with the female pattern of the teeth extending throughout the width, if sizes of the split dies and other tools are same. However, this is not a problem in the practice of designing rack bars.

The present invention should not be limited to the embodiment as explained above with reference to the drawings. The present invention can be modified or improved appropriately in practice without loss of the effectiveness within the technological concepts and features of the present invention. For example, in the case of flattening a part of an outer surface of a steel tube, deformations other than a simple flat surface should be included within the scope of the present invention, so long as it does not deviate from spirit of this invention. Similarly, in some cases the surface of a mandrel to be countered to the inner surface of the flattened part of a steel tube, may be deformed differently from a simple flatness.

What is claimed is:

1. A method of manufacturing a hollow rack bar by processing a part of a steel tube and forming a rack thereon, the method comprising:

holding the steel tube in a set of split dies, wherein the split dies have an interior shape that encircles an entire circumference of the steel tube at the part to be processed and adjacent portions of the steel tube at both sides of the part to be processed;

inserting a punch into an opening in the dies in a closed state of the dies and flattening the part of the steel tube;

inserting a rack forming die into the opening of the dies, wherein the rack forming die has an inner shape that conforms to the opening in the set of split dies;

holding the rack forming die in contact with the flattened part of the steel tube in the closed state of the dies; and inserting mandrels into the steel tube and forming a rack pattern corresponding to the rack forming die by ironing the flattened part of the steel tube from the interior of the steel tube.

2. The method as claimed in claim 1, further comprising inserting a core bar into the steel tube during flattening of the steel tube with the punch.

3. The method as claimed in claim 2, wherein the punch and the rack forming die are alternately inserted into the opening of the set of split dies, for flattening the steel tube and for forming the rack pattern, respectively.

4. The method as claimed in claim 1, wherein the punch and the rack forming die are alternately inserted into the opening of the set of split dies, for flattening the steel tube and for forming the rack pattern, respectively.

5. A method of manufacturing a hollow rack bar by processing a part of a steel tube and forming a rack thereon, the method comprising:

holding the steel tube in a first set of split dies, wherein the first set of split dies have an interior shape that encircles an entire circumference of the steel tube at the part to be processed and adjacent portions of the steel tube at both sides of the part to be processed;

inserting a punch into an opening in the first set of split dies, in a closed state thereof, and flattening the part of the steel tube;

holding the steel tube in a second set of split dies, wherein the second set of split dies have an interior shape that encircles the entire circumference of the steel tube at the flattened part;

inserting a rack forming die into an opening of the second set of split dies, wherein the rack has an inner shape that is the same as the dies;

holding the rack forming die in contact with the flattened part of the steel tube in a closed state of the second set of split dies; and successively inserting mandrels into the steel tube and forming a rack pattern corresponding to the rack forming die by ironing the flattened part of the steel tube from the interior of the steel tube.

6. The method as claimed in claim 5, further comprising inserting a core bar into the steel tube during the flattening of the steel tube with the punch.

7. An apparatus for producing a hollow rack bar, the apparatus comprising:

at least one set of split dies, wherein the set of split dies define an interior space and an opening communicating with the interior space, wherein the interior space is adapted to surround at least a part of a steel tube to be processed;

a punch having a flat surface for flattening the part of the steel tube upon insertion of the punch into the opening in the split dies;

a rack forming die having a rack forming pattern, wherein the rack forming die can be inserted in the opening in the split dies to contact the flattened part of the steel tube; and a plurality of mandrels for insertion into the steel tube to form a rack pattern, corresponding to the rack forming pattern on the rack forming die, by ironing the flattened part of the steel tube from the interior of the steel tube.

8. The apparatus as claimed in claim 7, wherein the rack forming die has a tube contacting surface that includes a first projecting portion that is continuous along a first edge of the rack forming die, and a second projecting portion that is continuous along a second edge of the rack forming die.

* * * * *

UNITED STATES PATENT AND TRADEMARK OFFICE

CERTIFICATE OF CORRECTION

PATENT NO. : 6,494,073 B2
DATED : December 17, 2002
INVENTOR(S) : Kazutomi Oka et al.

It is certified that error appears in the above-identified patent and that said Letters Patent is hereby corrected as shown below:

Column 4,
Line 35, change “lump” to -- lumps --.

Column 5,
Line 25, change “use of” to -- when using --.
Line 58, change “an inner” to -- a --.

Column 6,
Lines 29-30, change “has an inner shape that is the same as the dies” to -- forming die has a shape that conforms to the opening in the second set of split dies --

Signed and Sealed this

Twenty-eighth Day of October, 2003

JAMES E. ROGAN
*Director of the United States Patent and Trademark Office*